US007445278B2

(12) United States Patent
Wiecek

(10) Patent No.: US 7,445,278 B2
(45) Date of Patent: Nov. 4, 2008

(54) SLEEP OVER RECLINER CHAIR

(75) Inventor: Glenn N. Wiecek, Shelbyville, KY (US)

(73) Assignee: L & P Property Management Company, South Gate, CA (US)

( * ) Notice: Subject to any disclaimer, the term of this patent is extended or adjusted under 35 U.S.C. 154(b) by 14 days.

(21) Appl. No.: 11/412,679

(22) Filed: Apr. 27, 2006

(65) Prior Publication Data

US 2007/0257525 A1 Nov. 8, 2007

(51) Int. Cl.
*A47C 1/02* (2006.01)
*A61G 15/02* (2006.01)

(52) U.S. Cl. ..... 297/69; 297/83; 297/326; 297/423.2

(58) Field of Classification Search ..... 297/69, 297/83, 326, 328, 423.2
See application file for complete search history.

(56) References Cited

U.S. PATENT DOCUMENTS 1,984,281 A * 12/1934 Poggendorf ..... 297/317
3,572,823 A * 3/1971 Hampton ..... 297/85
5,312,161 A * 5/1994 Mars ..... 297/423.2
5,348,367 A * 9/1994 Mizelle ..... 297/83
5,527,095 A * 6/1996 Marshall et al. ..... 297/270.1
6,000,758 A * 12/1999 Schaffner et al. ..... 297/344.17
6,846,042 B2 * 1/2005 Hanson et al. ..... 297/411.36
7,025,415 B1 * 4/2006 Wu ..... 297/119

OTHER PUBLICATIONS

La-Z-Boy Contract Furniture Group: Healthcare: Catalog. Website: http://www.paraconfurn.com/Impublic/health/catalog/detail.jsp?page=thumbProducts: Copyright 2006.
IOA Healthcare Furniture: Website: http://www.ioa-hcf.com/Products.asp.

* cited by examiner

*Primary Examiner*—Sarah B McPartlin
(74) *Attorney, Agent, or Firm*—Shook Hardy & Bacon LLP

(57) ABSTRACT

This invention is related to a sleep over recliner chair having a footrest mechanism and a recliner mechanism that operate independently of one another. The sleep over recliner chair includes a footrest, a seat, back, and a pair of spaced apart armrests. Further, the sleep over recliner chair includes a base, a reverse tilt mechanism coupled with the base, and a linkage mechanism coupled with the reverse tilt mechanism. The linkage mechanism includes a recliner mechanism and a footrest mechanism. The footrest mechanism is adapted to move between a first, closed position and a second, open position. The recliner mechanism is adapted to move between a first, upright position and a second, fully reclined position. Further, the footrest and recliner mechanisms operate independently of one another.

24 Claims, 8 Drawing Sheets

SLEEP OVER RECLINER CHAIR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a sleep over recliner chair, and more particularly to a sleep over recliner chair having a recliner mechanism and a footrest mechanism that operate independently of one another.

Sleep over recliners are common in the furniture industry. Typically, sleep over recliners are chairs with extendable footrests that allow the user to recline in several positions. Sleep over recliner chairs usually contain a linkage mechanism comprised of a footrest mechanism, a recliner mechanism, a drive mechanism, and a sequencing link. A sleep over recliner chair typically has four positions in use: a closed, stowed position; an open, reclining position; a fully-reclined position; and a trendelenberg position.

The sequencing link along with the drive mechanism operate to provide synchronous movement between the recliner mechanism and the footrest mechanism when the sleep over chair is moved from position to position. However, the sequencing link and drive mechanism prohibit independent movement of the recliner mechanism and the footrest mechanism. As such, the user can only move a traditional sleep over recliner chair in a specific way. For example, if the user has placed the chair in the reclining position, the fully-reclined position, or the trendelenberg position, the user may not simply close the footrest. Further, the user would also not be able to simply recline the back of the chair into the fully-reclined position without first extending the footrest mechanism.

Thus, while sleep over recliner chairs are known, there remains a need for an improved sleep over recliner chair with independently functioning recliner and footrest mechanisms that provide the user multiple options for movement between seating, reclining, and sleeping positions.

BRIEF SUMMARY OF THE INVENTION

Accordingly, the present invention provides a sleep over recliner chair having a recliner mechanism and a footrest mechanism that operate independently of one another. As such, the sleep over recliner chair can be moved between a closed, chair position, position one, as shown in FIG. 7; an open, recliner TV position, position two, as shown in FIG. 8; an open, fully-reclined position, position three, as shown in FIGS. 5 and 10; and a closed, fully-reclined position, position four, as shown in FIG. 9. Further, the recliner mechanism is mounted on a reverse tilt mechanism. The reverse tilt mechanism operates to place the sleep over recliner chair in a trendelenberg position, as shown in FIG. 6. Additionally, if the reverse tilt mechanism is moved from the first position to the second position, so will the linkage mechanism that is mounted thereon. A brief overview of the sleep over recliner chair and its components follows immediately below. A more detailed description is provided in the Detail Description of the Invention section.

In general, the sleep over recliner chair includes a base, a reverse tilt mechanism mounted on the base, a seat, a footrest, a backrest, and a pair of linkage mechanisms mounted on the reverse tilt mechanism on opposite sides of the chair. The reverse tilt mechanism broadly includes a pair of support brackets, a tilt bracket, and a lift mechanism. The support brackets are mounted on the base and the tilt bracket is rotatably coupled to the support brackets such that the lift mechanism moves the reverse tilt mechanism from a first position to a second position.

Each of the linkage mechanisms includes a recliner mechanism and a footrest mechanism. The recliner mechanism is coupled to the reverse tilt mechanism. The footrest mechanism is connected to the recliner mechanism by a footrest extension linkage. The footrest extension linkage serves to unlock the footrest mechanism thereby allowing the weight of the user, along with the drive mechanism, to move the chair from the chair position to the recliner position.

The recliner mechanism broadly includes a base plate, a seat mount plate, a full recline link, a lift link, a control linkage, and a back linkage. The base plate is mounted on the reverse tilt mechanism. The full recline link couples the seat mount plate to the base plate while the carrier link couples the base plate to the back linkage. The control linkage is coupled to the footrest extension linkage and cooperates therewith to move the footrest mechanism between the open and closed positions. Further, the control linkage cooperates with the back linkage to move the backrest between the upright position and the fully-reclined position. As such, the footrest mechanism and the recliner mechanism can move independently of one another.

In operation, to move the recliner from between the closed, chair position, position one, as shown in FIG. 7 to the open, recliner TV position, position two, of FIG. 8, the user rotates a release lever or other activation means rearwardly. The rearward rotation of the lever or other activation means serves to unlock the footrest extension linkage, thereby allowing the weight of the user to move the linkage mechanism from position one to position two. The unlocking of the footrest extension linkage also allows the control mechanism to assist in moving the footrest mechanism from the closed, chair position to the open, recliner position. To fully recline the sleep over recliner the user simply applies a force to the backrest. The rearward force engages the back linkage. This rearward motion of the back linkage engages the seat mount plate and the lift link and causes the seat to rise. The rearward motion of the back linkage also moves the recliner mechanism from the upright position to the fully-reclined position. It should be understood that the user may also fully recline the recliner mechanism without the footrest being extended. Further, it should be understood that the user may close the footrest mechanism while the recliner mechanism is in the fully-reclined position.

As will be seen from the detailed description that follows, the invention provides a rocker recliner chair that contains a recliner mechanism and a footrest mechanism that operate independently of one another. Additional advantages, and novel features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
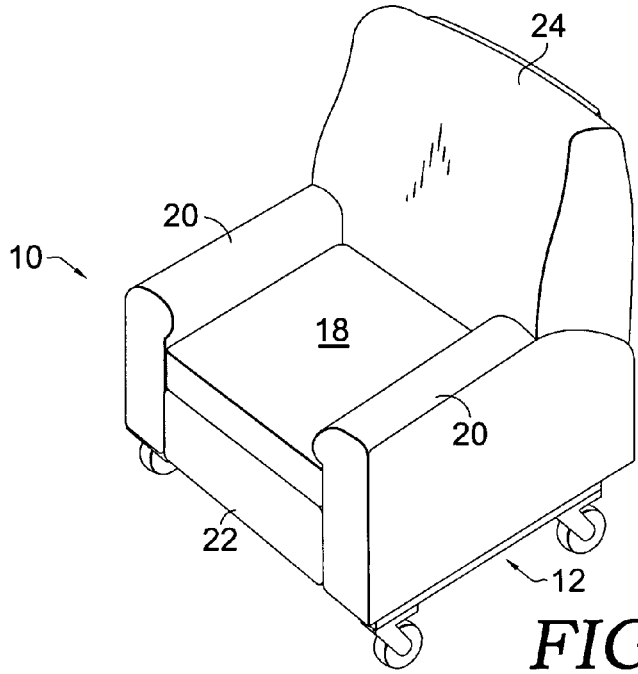
FIG. 1 is a front perspective view of a sleep over recliner chair in the closed, chair position according to the present invention.

Referring to the drawings in greater detail and initially to FIG. 1, a sleep over recliner chair is shown and designated generally by the numeral 10.

Figure 5:
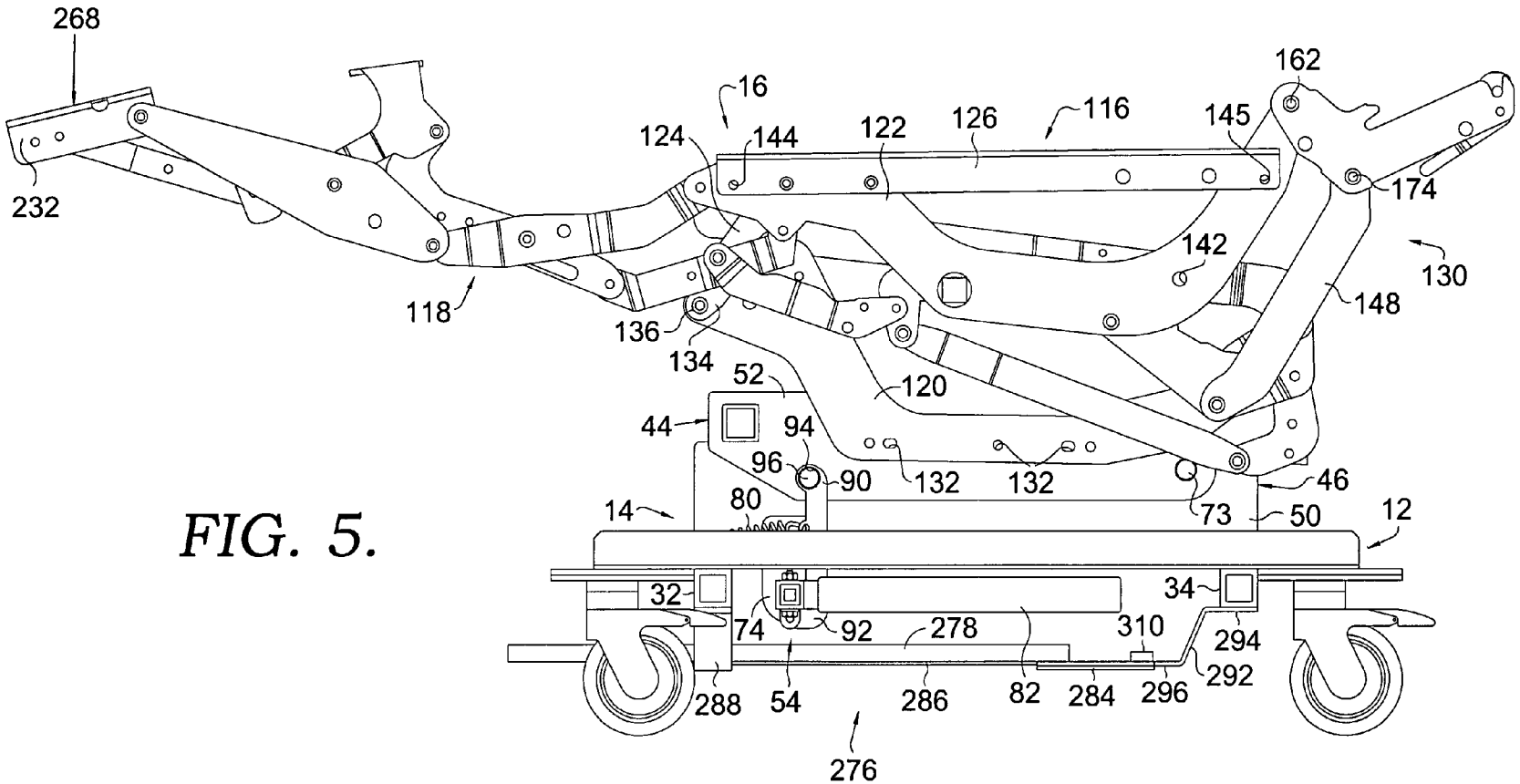
FIG. 5 is a cross-sectional view of the base, the reverse tilt mechanism, and the linkage mechanism, showing the linkage mechanism in a fully-reclined position, the reverse tilt mechanism in a first position, and the foot tray assembly in the hidden position.
Figure 6:
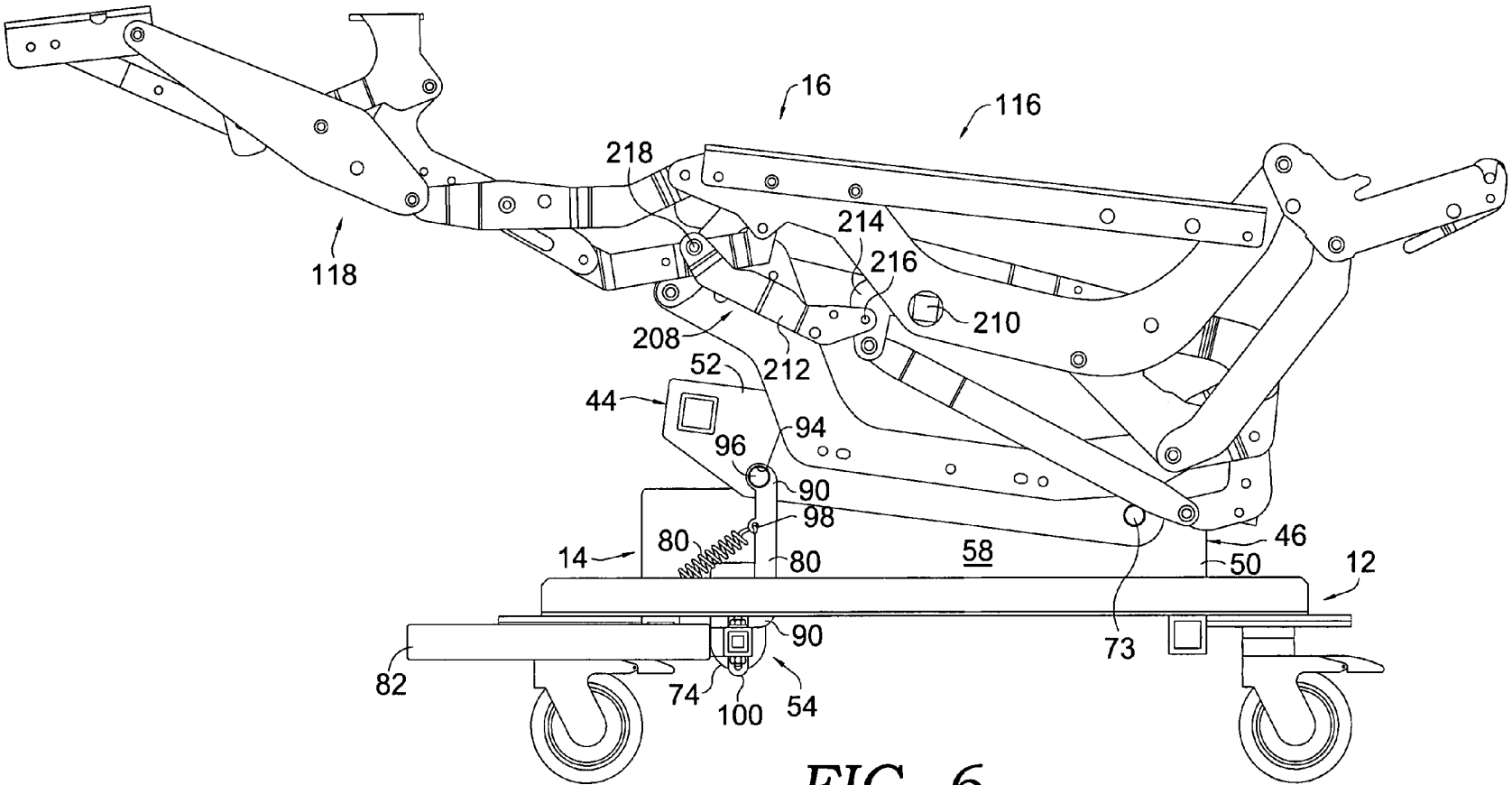
FIG. 6 is a cross-sectional view of the base, the reverse tilt mechanism, and the linkage mechanism, showing the linkage mechanism in the fully-reclined position and the reverse tilt mechanism in a second, trendelenberg position.
Figure 7:
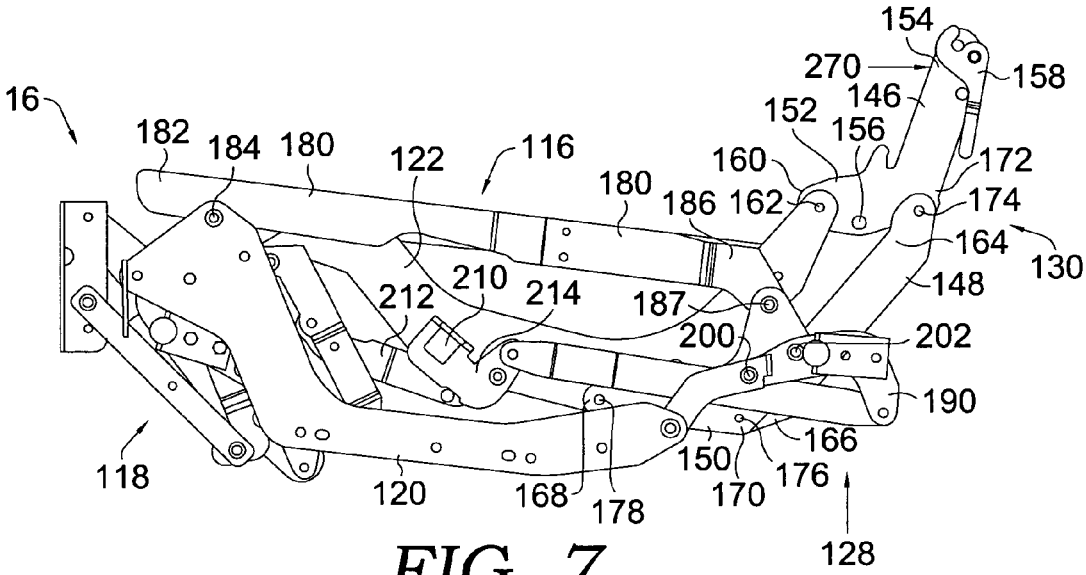
FIG. 7 is a cross-sectional view of the linkage mechanism, showing the linkage mechanism in a closed, chair position.
Figure 9:
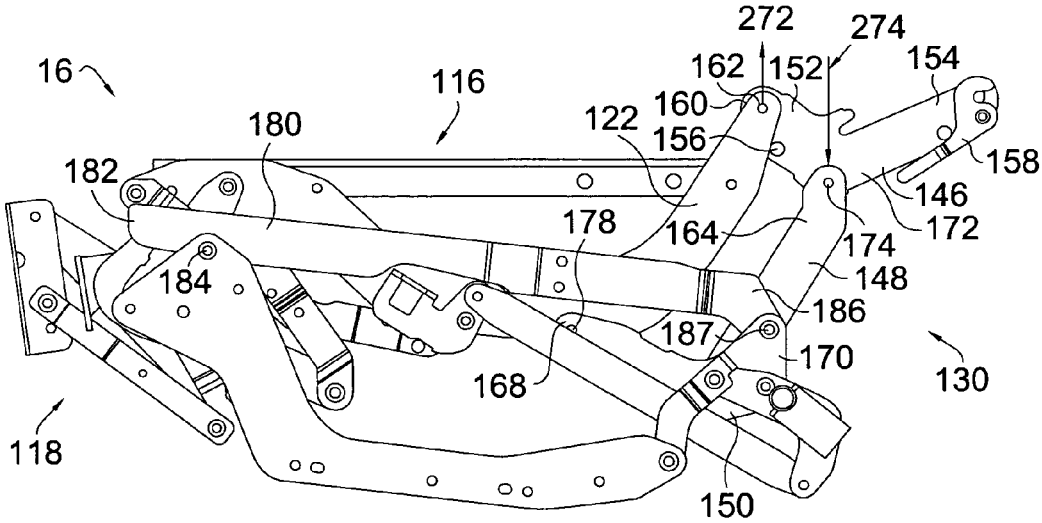
FIG. 9 is a view similar to FIG. 7, but with the linkage mechanism in a closed, fully-reclined position.
Figure 8:
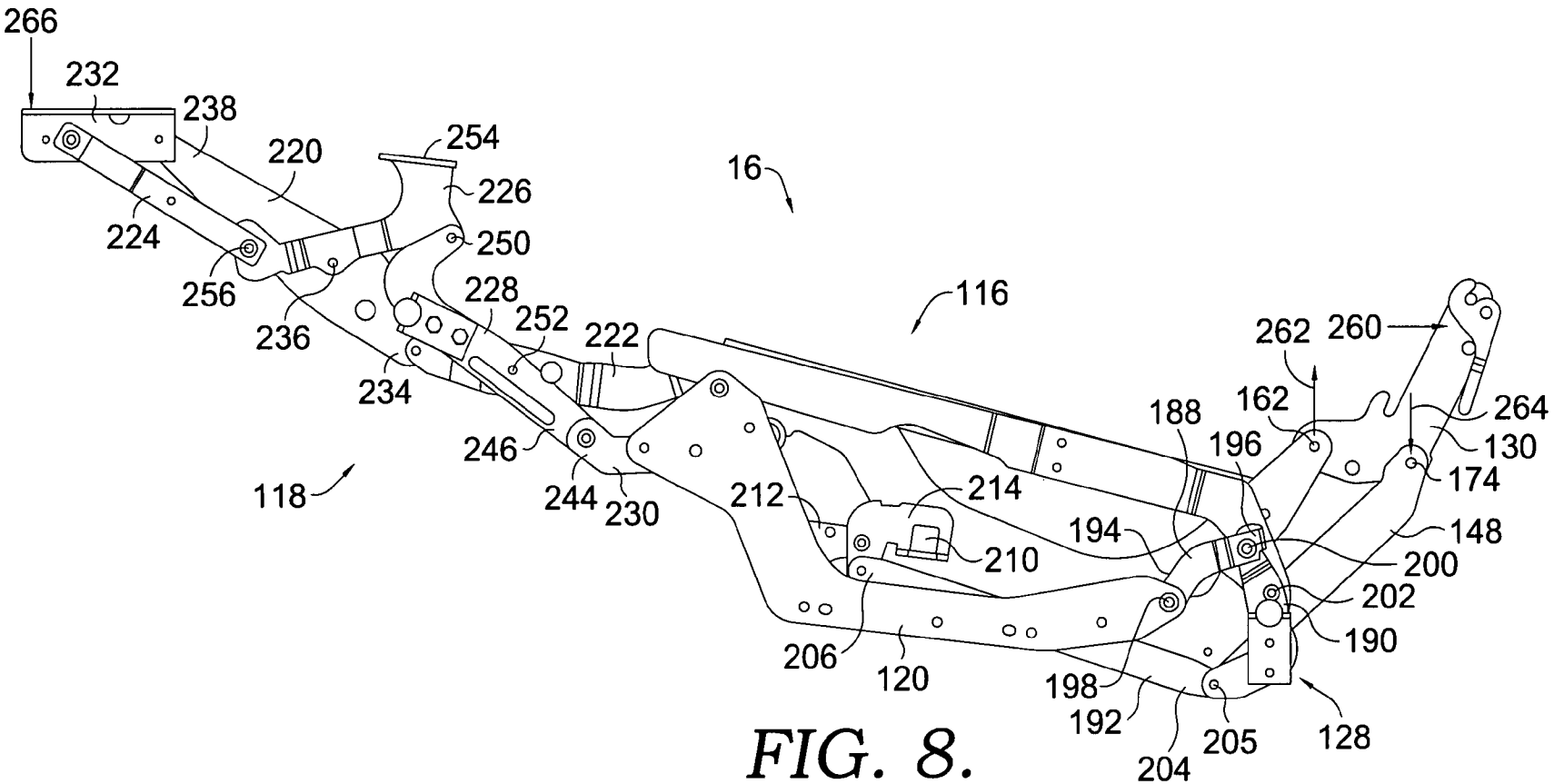
FIG. 8 is a view similar to FIG. 7, but with the linkage mechanism in the open, recliner TV position.
Figure 10:
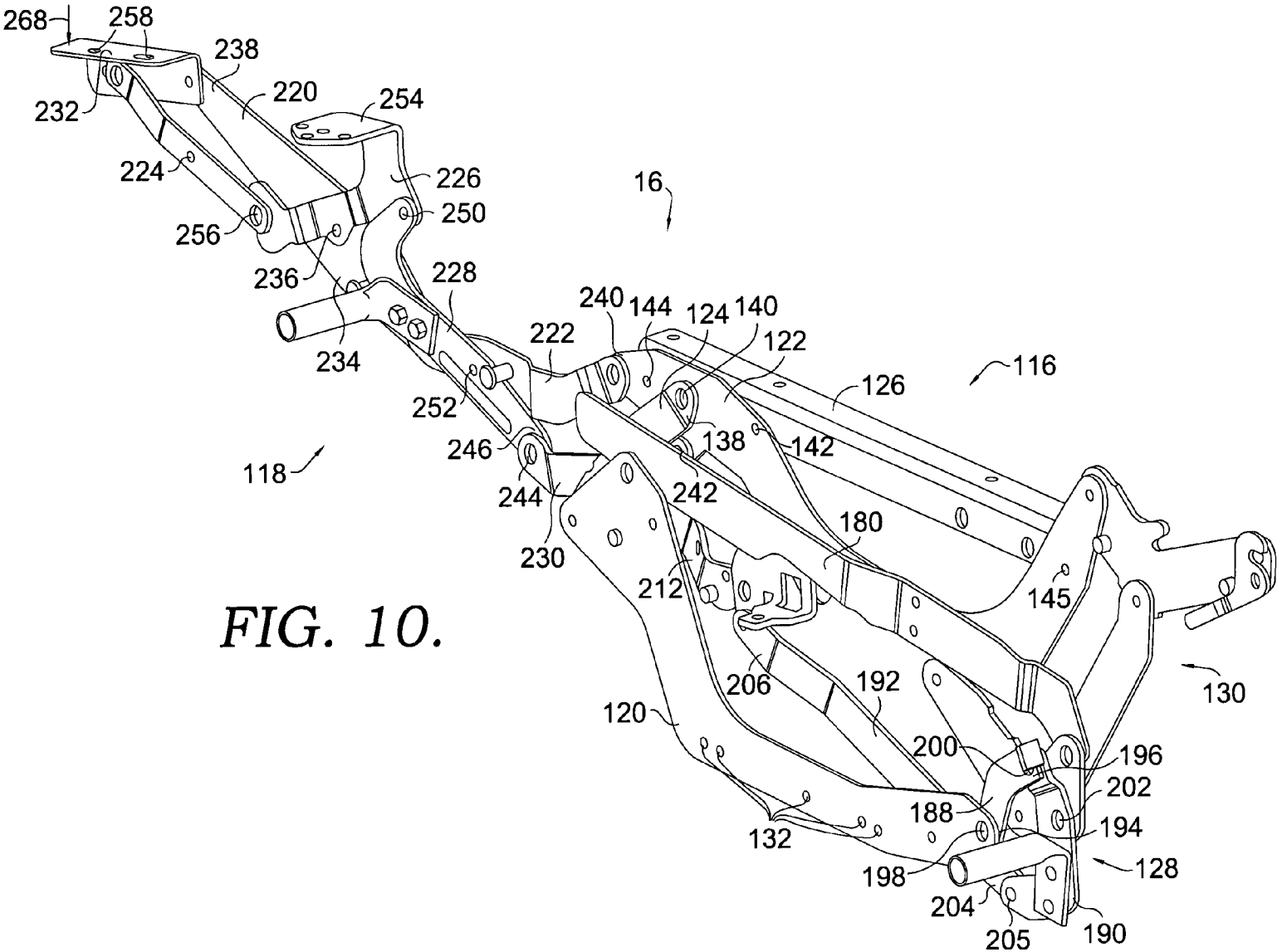
FIG. 10 is a partial perspective view of the linkage mechanism in the fully-reclined position.

Generally, as best seen in FIGS. 1, 5, and 6, the chair 10 broadly includes a base 12, a reverse tilt mechanism 14, and a pair of linkage mechanisms 16. The pair of linkage mechanisms 16 are mounted on the reverse tilt mechanism 14, which is in turn, mounted on the base 12. The pair of linkage mechanisms 16 mount a seat 18, a pair of upstanding opposed armrests 20, a footrest 22, and a backrest 24 for movement between multiple positions. Specifically, FIG. 7 represents the linkage mechanism 16 in the closed, chair position, position one. FIG. 8 represents the linkage mechanism 16 in the open, recliner, TV position, position two. FIGS. 5 and 10 represent the linkage mechanism 16 in the open, fully-reclined position, position three with the reverse tilt mechanism in the first position. FIG. 9 represents the linkage mechanism 16 in the closed, fully-reclined position, position four. FIG. 6 represents the linkage mechanism 16 in fifth, trendelenberg position; the open, fully-reclined position, with the reverse tilt mechanism in the second position. Further, as shown in FIGS. 5 and 6, the recliner mechanism sits on the reverse tilt mechanism 14. Additionally, the reverse tilt mechanism 14 may be moved from the first position to the second position with the linkage mechanism 16 in any position shown in FIGS. 7-9. As such, it should be understood that any of the above positions, positions one through four, shown in FIGS. 5 and 7-9, can be moved from the first position to the second position on the reverse tilt mechanism.

Figure 2:
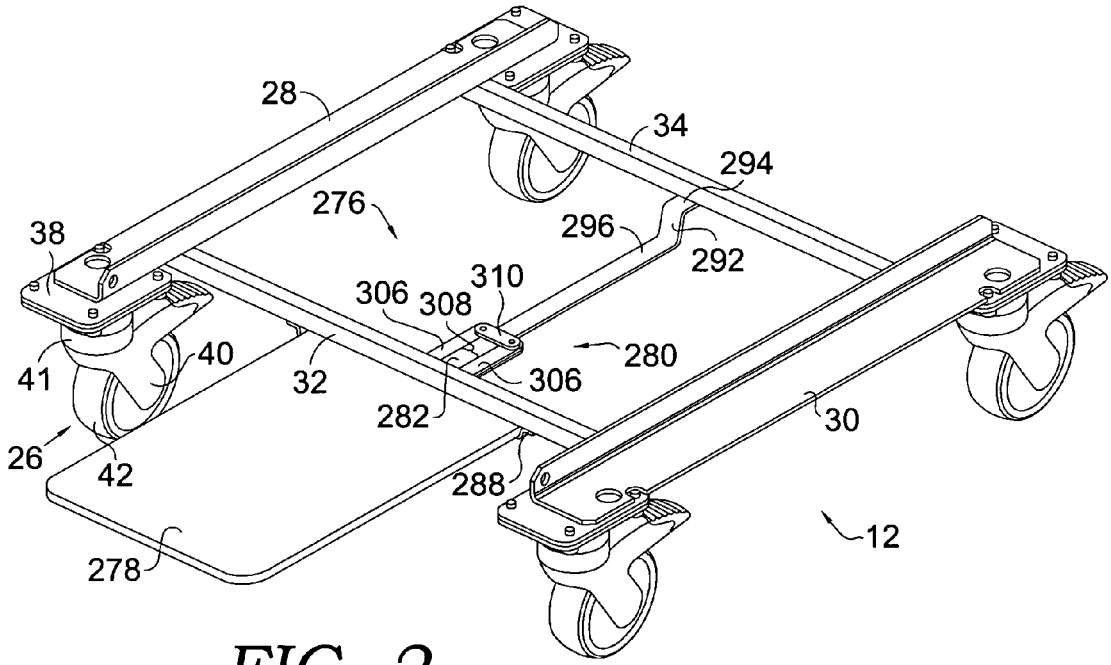
FIG. 2 is a front perspective view of a base of the sleep over recliner chair with a foot tray assembly in an extended position.
Figure 3:
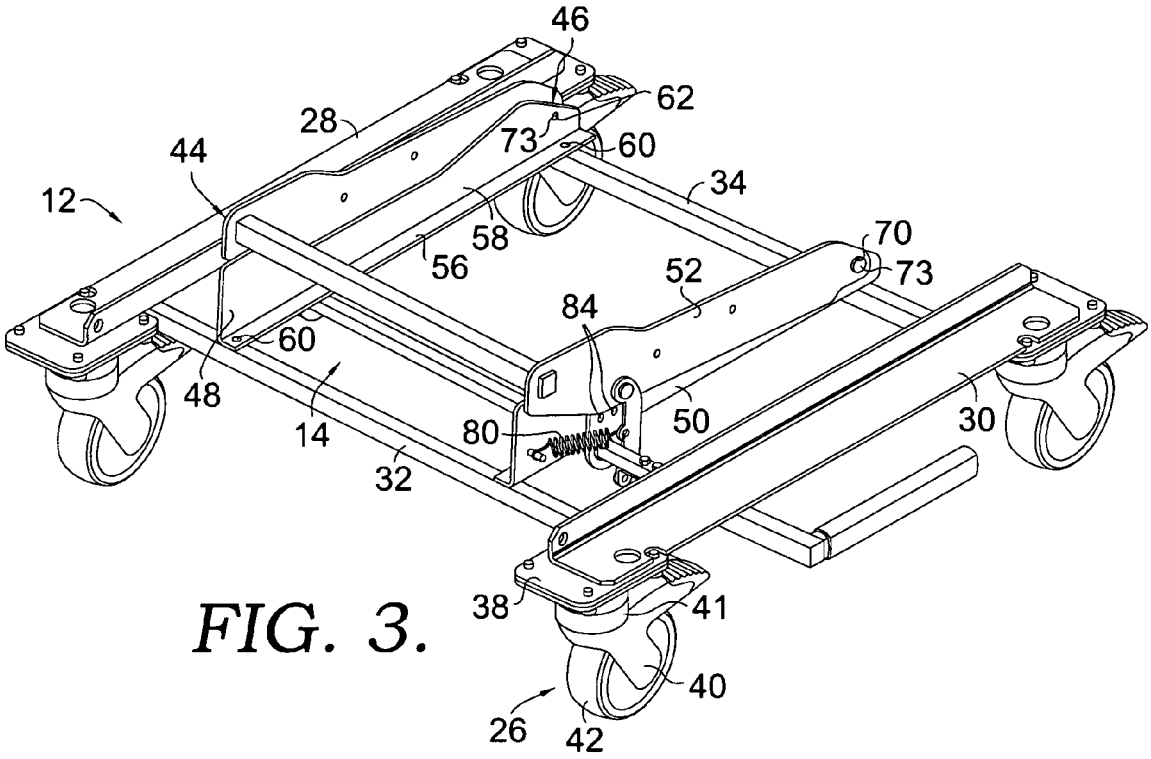
FIG. 3 is a front perspective view of the base and a reverse tilt mechanism.

Referring now to FIGS. 2 and 3, the base 12 will be discussed. The base 12 includes a wheel support assembly 26, a pair of outer brackets 28, 30 and a pair of cross tubes 32, 34. The pair of outer brackets 28, 30 are spaced apart and interconnected by the pair of cross tubes 32, 34. A mount plate 38 is coupled to each end of the outer brackets 28, 30. The wheel support assembly 26 contains four wheel supports, each of which are disposed at ends of the outer brackets 28, 30. The wheel support assembly 26 is known in the art and includes a housing 40 and a wheel 42. The housing 40 is rotatably coupled with the mount plate 38 via a collar 41, and the wheel 42 is received within the housing 40. As such, the wheel support assembly 26 provides a rotatable wheel 42 at each end of the base 12, thereby allowing the sleep over recliner chair 10 to roll.

Referring now to FIGS. 3-6, the reverse tilt mechanism 14 will be discussed. The reverse tilt mechanism 14 includes front and rear portions 44, 46 and is mounted on the base 12. The reverse tilt mechanism 14 includes a pair of support brackets 48, 50, a tilt bracket 52, and a lift mechanism 54. The pair of support brackets 48, 50 each include a flange 56 and a sidewall 58. The flange 56 is oriented generally horizontally and includes a pair of apertures 60. The apertures 60 are used to mount the pair of support brackets 48, 50 and, thus, the reverse tilt mechanism 14 to the pair of cross tubes 32, 34 on the base 12. The sidewall 58 depends upwardly from the flange 56 and contains a rear aperture 62 for mounting the tilt bracket 52.

Figure 4:
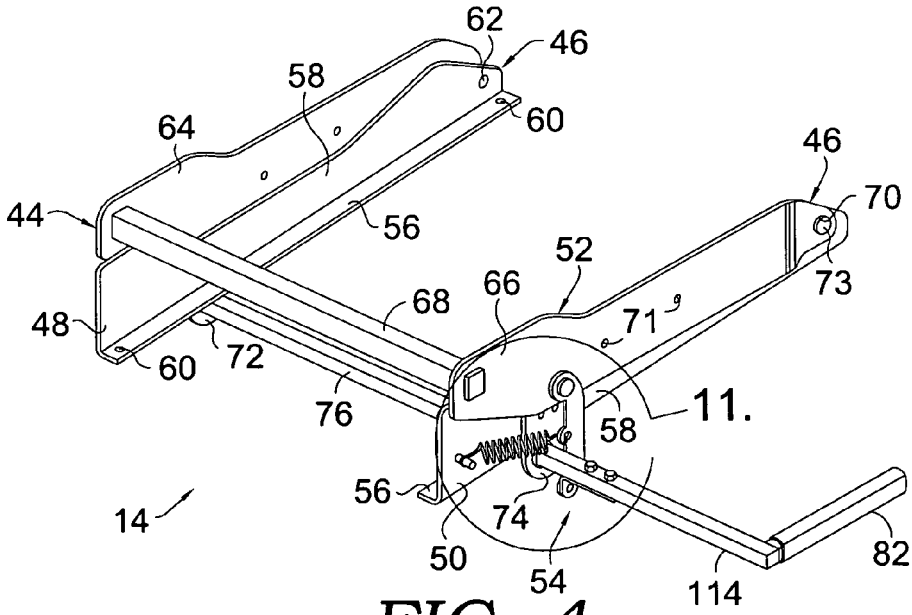
FIG. 4 is a front perspective view of the reverse tilt mechanism.

Referring now to FIG. 4, the tilt bracket 52 will be discussed. The tilt bracket 52 includes a pair of side flanges 64, 66 and a cross tube 68. The pair of side flanges 64, 66 include a rear aperture 70 and a pair of mounting apertures 71. The pair of side flanges 64, 66 are rotatably coupled with the pair of support brackets 48, 50 via the rear apertures 70, 62 on each respective member. As such, the side flanges 64, 66 of the tilt bracket 52 are rotatably coupled with the support brackets 48, 50 proximate the rear portion 46 of the reverse tilt mechanism 14. Coupling occurs via a pair of pins 73. However, it should be understood that any suitable coupling method may be used. The cross tube 68 interconnects the side flanges 64, 66 and is fixably coupled therewith proximate the front portion 44 of the reverse tilt mechanism 14.

Figure 11:
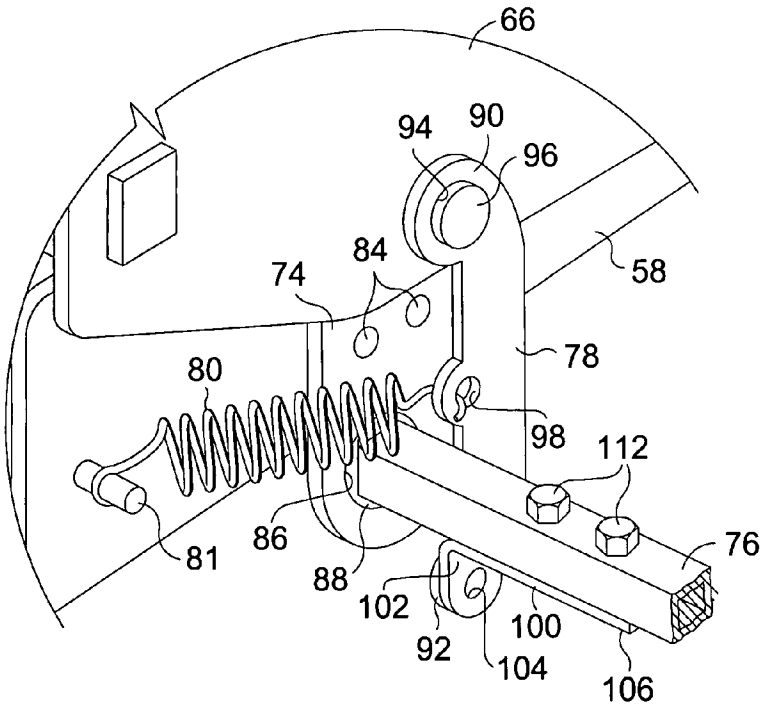
FIG. 11 is an enlarged view of the lift mechanism of FIG. 4.

Referring now to FIGS. 4 and 11, the lift mechanism 54 will be discussed. The lift mechanism 54 includes a pair of mounting brackets 72, 74, a rod 76, a pair of lift links 78, a spring 80, and a handle 82. The mounting brackets 72, 74 are fixably coupled to the sidewalls 58 proximate the front portion 44 of the reverse tilt mechanism 14. The mounting brackets 72, 74 are coupled via rivets 84 and include an enlarged aperture 86 with a bearing 88 that receives the rod 76. As such, the rod 76 is coupled with the sidewalls 58 via the mounting brackets 72, 74. The rod 76 is further coupled with the lift links 78 which are, in turn coupled with the tilt bracket 52.

The lift links 78 are shaped as shown and are located outwardly of side flanges 64, 66 of the tilt bracket 52. The lift links 78 are coupled with the tilt bracket 52 at a first end 90 and with the rod 76 at a second end 92. Coupling occurs via an aperture 94 and rivet 96 combination as is understood in the art. However, it should be understood that any suitable attachment method may be used. The lift link 78 further includes a centrally located aperture 98 that attaches to a spring 80 which is coupled to a protrusion 81 on sidewall 58. An L-bracket 100 is used to couple the tilt bracket 52 with the rod 76 at the second end 92. The L-bracket 100 includes a mounting portion 102 with an aperture 104 and a flange portion 106. The aperture 104 of the mounting portion 102 is coupled with the second end 92 of the lift links 78 and the flange portions 106 is coupled with the rod 76 via a pair of bolts 112.

The handle 82 is coupled to an end 114 of the rod 76. As such, when the handle 82 is moved from a first position, shown in FIG. 5, to a second position, shown in FIG. 6, the movement of the L-bracket 100 coupled with the rod 76 moves the lift links 78. Movement of the lift links 78 causes the tilt bracket 52 to rotate about the pinned connection 73 between the rear apertures 70, 62 located on the tilt bracket 52 and the pair of support brackets 48, 50 respectively, and causes the front portion 44 of the reverse tilt mechanism 14 to move upwardly with respect to the rear portion 46 of the reverse tilt mechanism 14, as will be further discussed below.

Turning now to FIGS. 5-10, the linkage mechanism 16 will be discussed. The linkage mechanism 16 broadly includes a recliner mechanism 116 and a footrest mechanism 118. As shown in FIGS. 5 and 6, the recliner mechanism 116 is fixably coupled to the reverse tilt mechanism 14. The footrest mechanism 118 is rotatably coupled to the recliner mechanism 116. However, as stated above the recliner mechanism 116 and the footrest mechanism 118 operate independently of one another. FIG. 7 shows the footrest mechanism 118 in the closed position and the recliner mechanism 116 in the upright position. FIG. 8 shows the footrest mechanism 118 in the open position and the recliner mechanism 116 in the upright position. FIGS. 5 and 10 show the footrest mechanism 118 in the open position and the recliner mechanism 116 in the fully reclined position. FIG. 9 shows the footrest mechanism 118 in the closed position and the recliner mechanism 116 in the fully reclined position. Movement between these positions will be discussed further below.

Referring now to FIGS. 5 and 10, the recliner mechanism 116 is discussed in detail. The recliner mechanism 116 broadly includes a base plate 120, a seat mount plate 122, a full recline link 124, a lift link 126, a control linkage 128, and a back linkage 130. The base plate 120 is fixably mounted on the tilt bracket 52 of the reverse tilt mechanism 14. The base plate 120 is an elongated piece of stamped steel, shaped as shown, with a plurality of connecting apertures 132. The full recline link 124 serves to interconnect the base plate 120 with the seat mount plate 122. A lower portion 134 of the full recline link 124 is rotatably coupled to the base plate 120 at connection 136, while an upper portion 138 of the full recline link 124 is rotatably coupled to the seat mount plate 122 at connection 140. It should be appreciated that any suitable connection method may be used. The seat mount plate 122 is an elongated piece of stamped steel, shaped as shown, with a plurality of connecting apertures 142. The lift link 126 is coupled to the seat mount plate 122 at points 144, 145 and cooperates therewith to support the seat 18.

Referring now to FIGS. 7 and 9, the back linkage 130 is shown. The back linkage 130 is coupled to the seat mount plate 122. The back linkage 130 generally includes a back bracket 146, an intermediate link 148, and a lower link 150. The back bracket 146 is generally L-shaped and includes a lower leg 152, an upper leg 154, a stop 156, and a catch 158. A front portion 160 of the lower leg 152 is rotatably coupled to the seat mount plate 122 at point 162. The intermediate link 148 contains upper and lower portions 164, 166. The lower link 150 contains front and rear portions 168, 170. A rear portion 172 of lower leg 152 is rotatably coupled to the upper portion 164 of the intermediate link 148 at connection 174. The lower portion 166 of the intermediate link 148 is coupled with the rear portion 170 of the lower link 150 at connection 176. The front portion 168 of the lower link 150 is coupled with the seat mount plate 122 at connection 178. Again, any suitable attachment mechanism could be used. The upper leg 154 of the back bracket 146 contains the catch 158 that is used to couple the back bracket 146 with the back 20. The catch 158 is disclosed in U.S. patent application Ser. No. 11/290,401, the contents of which are herein incorporated by reference. The back linkage 130 is coupled with the base plate 120 by a carrier link 180. The carrier link 180 has a forward portion 182 that is coupled with base plate 120 at connection 184 and a rear portion 186 that is coupled with the rear portion 170 of the lower link 150 at connection 187.

Turning now to FIGS. 8 and 10, the control linkage 128 will be discussed. The control linkage 128 includes a connector link 188, a pivot link 190, and a drive link 192. The connector link 188 is shaped at shown and includes first and second ends 194, 196. The first end 194 is coupled with the base plate 120 at connection 198 while the second end 196 is coupled with the pivot link 190 at connection 200. The pivot link 190 is coupled with the lower link 150 at connection 202. The drive link 192 contains first and second ends 204, 206, the first end 204 being coupled with the pivot link 190 at connection 205 and the second end 206 being coupled with the footrest mechanism 118.

Returning to FIG. 6, and the discussion of the linkage mechanism 16, the footrest mechanism 118 is connected to the recliner mechanism 116 by a footrest extension linkage 208. It will be understood that the footrest extension linkage 208 cooperates with the footrest mechanism 118 to place the footrest mechanism 118 in an open position as best seen in FIG. 8 and in a closed position as best seen in FIGS. 7 and 9. Footrest extension linkage 208 further help the footrest mechanism 118 to remain in the open position as chair 10 moves to the fully-reclined position as best seen in FIGS. 6, 8 and 10. However, it should be understood that the footrest mechanism 118 and recliner mechanism 116 operate independently of one another, as will be discussed further below.

The discussion will next focus on the footrest extension linkage 208. As shown in FIG. 6, the footrest extension linkage 208 generally includes a handle, not shown, a shaft 210, an ottoman link 212, and a release link 214. As shown in FIG. 6, the shaft 210 is pivotally mounted between the seat mount plates 122 on each linkage mechanism 16. The handle or other activation means, not shown, is typically positioned on one side of chair 10 and is fixably mounted to shaft 210. Returning to FIG. 6, release link 214 is fixably mounted to the shaft 210 and is rotatably coupled to the ottoman link 212 at point 216. Ottoman link 212 is rotatably coupled to the footrest mechanism 18 at point 218 as will be further described below. Thus, ottoman link 212 serves to interconnect the release link 214 and the footrest mechanism 118.

Returning to FIGS. 8 and 10, the footrest mechanism 118 will now be discussed. The footrest mechanism 118 includes a front link 220, an upper link 222, a rocker link 224, a mid link 226, an intermediate link 228, a rear link 230, and a bracket 232. The front link 220 includes a first end 234, a pivot 236, and a second end 238. The front link 220 is coupled to the bracket 232 at second end 238 and is rotatably coupled to the upper link 222 at first end 234. Opposite the connection to the first end 234, the upper link 222 is coupled to a forward portion 240 of the seat mount plate 122.

The rear link 230 contains a first end 242 coupled with the seat mount plate 122 and a second end 244 coupled with an end 246 of the intermediate link 228. The ottoman link 212 is coupled with an intermediate portion of the rear link 230 at connection 218, as shown in FIG. 6. The intermediate link 228 is shaped as shown and is coupled with the mid link 226 at connection 250. The intermediate link 228 is also coupled with the upper link 222 at connection 252 and, thus, forms a scissor linkage with upper link 222. The mid link 226 is shaped as shown and includes a mounting flange 254. It should be understood that the mounting flange 254 supports a portion of the footrest 22, not shown. The mid link 226 is coupled with the front link 220 at connection 236 and the rocker link 224 at connection 256. Opposite the connection of rocker link 224 to mid link 226, the rocker link 224 is coupled with the bracket 232. The bracket 232 is generally rectangular and contains a number of apertures 258, see FIG. 10.

Figure 12:
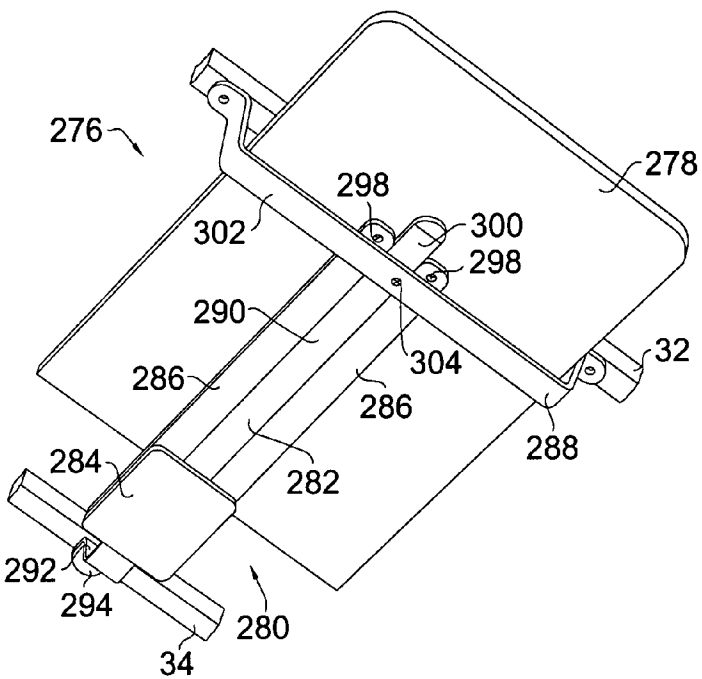
FIG. 12 is a perspective view of the foot tray assembly.

As shown in FIGS. 2, 5, and 12 the recliner chair further includes a foot tray assembly 276. The foot tray assembly 276 includes a foot tray 278 and a foot tray support 280. The foot tray 278 is generally rectangular and is slidably coupled to the base 12 via the foot tray support 280. The foot tray support 280 contains a support bar 282, a slide plate 284, a pair of links 286, and a bracket 288. The bracket 288 is shaped as shown and is coupled with cross tube 32. The support bar 282 is shaped as shown and includes an elongate member 290, a bend 292, and a mount tab 294. The bend 292 extends upwardly from a rear portion 296 of the elongate member 290 and the mount tab 294 extends rearwardly from the bend 292. The mount tab 294 contains an aperture, not shown, used to couple it with cross tube 34. A front portion 300 of the elongate member 290 is coupled with an intermediate portion 302 of the bracket 288 at aperture 304. The pair of links 286 are spaced apart and coupled with the foot tray 278 at apertures 298. The slide plate 284 is coupled with a rear portion 306 of the pair of links 286. The arrangement of the pair of links 286 on the slide plate 284 provide a channel 308 that receives the elongate member 290. A top link 310 is coupled with an upper surface 312 of the rear portion 306 of the pair of links 286. Thus, the top link 310 along with the channel 308 and the pair of links 286 serve to guide the elongate member 290 of the support bar 282 as the foot tray 278 is moved from the hidden position, shown in FIG. 5 to the extended position, shown in FIG. 2.

The operation of the sleep over recliner 10 is best described with reference to FIGS. 5-10. Initially, as stated above the footrest mechanism 118 and the recliner mechanism 116 operate independently of one another. Accordingly, a number of positions can be afforded the user to provide maximum comfort based on individual preference. Specifically, FIG. 7 represents the sleep over recliner chair 10 in the closed, chair position, position one; with the footrest mechanism 118 in the closed position and the recliner mechanism 116 is in the upright position. FIG. 8 represents the sleep over recliner chair 10 in the open, recliner TV position, position two; with the footrest mechanism 118 in the open position and the recliner mechanism 116 is in the upright position. FIGS. 5 and 10 represents the sleep over recliner chair 10 in the open, fully-reclined position, position three; with the footrest mechanism 118 in the open position and the recliner mechanism 116 is in the fully reclined position. FIG. 9 represents the sleep over recliner chair 10 in the closed, fully-reclined position, position four; with the footrest mechanism 118 in the closed position and the recliner mechanism 116 in the fully reclined position. Further, as shown in FIGS. 5 and 6, the linkage mechanism 16 sits on the reverse tilt mechanism 14. Additionally, if the reverse tilt mechanism 14 is moved from the first position to the second position, accordingly, so will the linkage mechanism 16. As such, it should be understood that any of the above positions, positions one through four, can be moved from the first position to the second position on the reverse tilt mechanism.

Referring now to FIGS. 7 and 8, if the occupant desires to convert from position one to position two, the user rotates the handle or other activation means, not shown, rearwardly. Rearward rotation of the handle or other activation means, in turn, causes a downward rotation of the release link 214 coupled thereto through shaft 210. The downward rotation of the release link 214 unlocks the ottoman link 212. Once the ottoman link 212 is unlocked, the weight of the user causes the recliner mechanism 116 to move forward.

In addition, the control linkage 128 also assists in moving the footrest extension linkage to the extended position. Once the footrest extension linkage has been released, the pivot link 190 rotates in a clockwise manner, with reference to FIG. 7, about point 202. This clockwise motion of the pivot link 190 moves the drive link 192 toward the front of the recliner 10. This translation of the drive link 192 assists in moving the footrest mechanism to the recliner TV position, position two, as shown in FIG. 8. It should be understood that the footrest mechanism may be returned to position one from position two by either turning the handle or other activation means in the opposite direction or by applying a downward force, as shown by reference numeral 266 on footrest 22, not shown, attached to bracket 232.

Referring now to FIGS. 5 and 8, to move from position two, shown in FIG. 8 to position three, shown in FIG. 5, an additional force as represented by reference numeral 260 is applied to back bracket 146 via back 24 (not shown). The force 260 applied to the back bracket 146 causes a clockwise rotation, with reference to FIGS. 5 and 8, of back bracket 146. The clockwise motion of back bracket 146 causes an upward pulling force at point 162, represented by reference numeral 262, and a downward pushing force at point 174, represented by reference numeral 264. The rotation of the back bracket 146 and the downward force 264 on the intermediate link 148 also causes an upward movement of the seat mount plate 122 and thus the lift link 126, as the recliner moves from position two to position three. It should be understood that the footrest mechanism may be placed in position four, shown in FIG. 9, from position three, shown in FIGS. 5 and 10, by either turning the handle or other activation means in the opposite direction or by applying a downward force, as shown by reference numeral 268 on footrest 22, not shown, attached to bracket 232.

It should also be understood that the chair 10 may be moved from closed, chair position, position one; with the footrest mechanism 118 in the closed position and the recliner mechanism 116 is in the upright position to the closed, fully-reclined position, position four; with the footrest mechanism 118 in the closed position and the recliner mechanism 116 in the fully reclined position. Specifically, the user applies a force 270 to the back bracket 146 causes a clockwise rotation, with reference to FIGS. 7 and 9, of back bracket 146. The clockwise motion of back bracket 130 causes an upward pulling force at point 162, represented by reference numeral 272, and a downward pushing force at point 174, represented by reference numeral 274. The rotation of the back bracket 130 and the downward force 264 on the intermediate link 148 also causes an upward movement of the seat mount plate 122 and thus the lift link 126, as the recliner moves from position one to position four.

To move the sleep over recliner from the open, fully-reclined position, position three, as shown in FIGS. 5 and 10; to the fifth, trendelenberg position, as shown in FIG. 6, the user simply moves the handle 82 from a first position, shown in FIG. 5, to a second position, shown in FIG. 6.

Specifically, as stated above, when the handle 82 is moved from a first position, shown in FIG. 5, to a second position, shown in FIG. 6, the movement of the L-bracket 100 coupled with the rod 76 moves the lift links 78. Movement of the lift links 78 causes the tilt bracket 52 to rotate about the pinned connection 73 between the rear apertures 70, 62 located on the tilt bracket 52 and the pair of support brackets 48, 50 respectively, and causes the front portion 44 of the reverse tilt mechanism 14 to move upwardly with respect to the rear portion 46 of the reverse tilt mechanism 14. The upward movement of the front portion 44 with respect to the rear portion 46 further reclines the linkage mechanisms 14 and places the sleep over recliner chair 10 in the trendelenberg position.

Further, it should be understood that the construction of the sleep over recliner chair 10 lends itself to be easily assembled and disassembled for shipping. Specifically the nature of the linkage mechanism 16, the reverse tilt mechanism 14, and base 12 allow the sleep over recliner chair 10 to be broken down and the individual parts to be shipped.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A sleep over recliner chair having a footrest, a seat, back, and a pair of spaced apart armrests, the chair comprising:

a base;

a reverse tilt mechanism coupled with the base; and a linkage mechanism coupled with the reverse tilt mechanism, the linkage mechanism including a recliner mechanism and a footrest mechanism, the footrest mechanism being adapted to move between a first position and a second position and the recliner mechanism being adapted to move between a first and second position;

wherein the recliner mechanism and the footrest mechanism operate independently of one another;

wherein the recliner mechanism is configured to adjust between the first position and the second position while the footrest mechanism resides in either the first position or the second position;

wherein the footrest mechanism is configured to adjust between the first position and the second position while the recliner mechanism resides in either the first position or the second position; and wherein the reverse tilt mechanism is adapted to operate independently of the linkage mechanism such that the recliner mechanism and the footrest mechanism reside in their present positions during adjustment between a first portion to a second position of the reverse tilt mechanism.

2. The sleep over recliner chair of claim 1, wherein the first position of the footrest mechanism is closed and the second position is open.

3. The sleep over recliner chair of claim 2, wherein the first position of the recliner mechanism is upright and the second position is fully-reclined.

4. The sleep over recliner chair of claim 3, wherein the reverse tilt mechanism includes a support bracket, a tilt bracket rotatably coupled with the support bracket, and a lift mechanism coupled to the support bracket and tilt bracket, the lift mechanism being adapted to move the reverse tilt mechanism from a first position to a second position.

5. The sleep over recliner chair of claim 4, wherein the tilt bracket is rotatably coupled with the support bracket proximate a rear portion of the reverse tilt mechanism.

6. The sleep over recliner chair of claim 5 wherein a front portion of the tilt bracket rotates upwardly when the reverse tilt mechanism moves from the first position to the second position.

7. The sleep over recliner chair of claim 6, wherein the second position of the reverse tilt mechanism is a trendelenberg position.

8. The sleep over recliner chair of claim 7, further comprising a foot plate slidably coupled with the base, the foot plate being movable from a first position to a second position.

9. The sleep over recliner chair of claim 8, wherein the first position is a hidden position and the second position is an extended position.

10. A mechanism for a sleep over chair, the mechanism comprising:

a reverse tilt mechanism being adapted to move from a first position to a second position; and a linkage mechanism coupled with the reverse tilt mechanism, the linkage mechanism including a recliner mechanism and a footrest mechanism, the recliner mechanism and the footrest mechanism being adapted to operate independently of one another;

wherein the footrest mechanism moves between a first position and a second position and wherein the recliner mechanism moves between a first and second position;

wherein the recliner mechanism is configured to adjust between the first position and the second position while the footrest mechanism resides in either the first position or the second position;

wherein the footrest mechanism is configured to adjust between the first position and the second position while the recliner mechanism resides in either the first position or the second position;

wherein the reverse tilt mechanism is adapted to operate independently of the linkage mechanism such that the recliner mechanism and the footrest mechanism reside in their present positions during adjustment between the first position to the second position of the reverse tilt mechanism.

11. The mechanism of claim 10, wherein the reverse tilt mechanism includes a support bracket, a tilt bracket rotatably coupled with the support bracket, and a lift mechanism coupled to the support bracket and tilt bracket, the lift mechanism being adapted to move the reverse tilt mechanism from the first position to the second position;

wherein the lift mechanism is activated to move the reverse tilt mechanism from the first position to the second position such that the activation of the lift mechanism is independent of means for activating the footrest mechanism and means for activating the recliner mechanism.

12. The sleep over recliner chair of claim 11, wherein the tilt bracket is rotatably coupled with the support bracket proximate a rear portion of the reverse tilt mechanism.

13. The sleep over recliner chair of claim 12, wherein a front portion of the tilt bracket rotates upwardly when the reverse tilt mechanism moves from the first position to the second position.

14. The mechanism of claim 13, wherein the first position of the footrest mechanism is closed and the second position is open; wherein adjustment from the first position to the second position is assisted by weight of an occupant in the sleep over chair.

15. The mechanism of claim 14, wherein the first position of the recliner mechanism is upright and the second position is fully-reclined.

16. The mechanism of claim 15, wherein the second position or the reverse tilt mechanism is a trendelenberg position.

17. The sleep over recliner chair of claim 16 further comprising a foot plate slidably coupled with the base, the foot plate being movable from a first position to a second position.

18. A sleep over recliner chair having a base, a footrest, a seat, back, and a pair of spaced apart armrests, the chair comprising:

a reverse tilt mechanism coupled with the base;

the reverse tilt mechanism being adapted to move from a first position to a second position; and a linkage mechanism coupled with the reverse tilt mechanism, the linkage mechanism including a recliner mechanism and a footrest mechanism, the recliner mechanism and the footrest mechanism being adapted to operate independently of one another;

wherein the footrest mechanism moves between a first position and a second position and wherein the recliner mechanism moves between a first and second position;

wherein the recliner mechanism is configured to adjust between the first position and the second position while the footrest mechanism resides in either the first position or the second position;

wherein the footrest mechanism is configured to adjust between the first position and the second position while the recliner mechanism resides in either the first position or the second position; and wherein the reverse tilt mechanism is adapted to operate independently of the linkage mechanism such that the recliner mechanism and the footrest mechanism reside in their present positions during adjustment between the first position to the second position of the reverse tilt mechanism.

19. The sleep over recliner chair of claim 18, wherein the first position of the footrest mechanism is closed and the second position is open.

20. The sleep over recliner chair of claim 19, wherein the first position of the recliner mechanism is an upright and the second position is fully-reclined.

21. The sleep over recliner chair of claim 20, wherein the reverse tilt mechanism includes a support bracket, a tilt bracket rotatably coupled with the support bracket, and a lift mechanism coupled to the support bracket and tilt bracket, the lift mechanism being adapted to move the reverse tilt mechanism from a first position to a second position.

22. The sleep over recliner chair of claim 18, wherein the tilt bracket is rotatably coupled with the support bracket proximate a rear portion of the reverse tilt mechanism.

23. The sleep over recliner chair of claim 22, wherein the second position or the reverse tilt mechanism is a trendelenberg position.

24. The sleep over recliner chair of claim 23, wherein the first position is a hidden position and the second position is an extended position.

* * * * *